US005438309A

United States Patent [19]

Krumme

[11] Patent Number: 5,438,309

[45] Date of Patent: Aug. 1, 1995

[54] OVER-CURRENT/OVER-TEMPERATURE PROTECTION DEVICE

[76] Inventor: John F. Krumme, 4124 Verbier Rd., Tahoe City, Calif. 96145

[21] Appl. No.: 133,187

[22] PCT Filed: Feb. 19, 1992

[86] PCT No.: PCT/US92/01185

§ 371 Date: Oct. 19, 1993

§ 102(e) Date: Oct. 19, 1993

[87] PCT Pub. No.: WO92/19002

PCT Pub. Date: Oct. 29, 1992

Related U.S. Application Data

[63] Continuation-in-part of Ser. No. 687,792, Apr. 19, 1991, Pat. No. 5,105,178.

[51] Int. Cl.[6] ..... H01H 61/06

[52] U.S. Cl. ..... 337/140; 337/395; 361/103

[58] Field of Search ..... 337/140, 395; 361/103

[56] References Cited

U.S. PATENT DOCUMENTS

| | | | |
|---|---|---|---|
| 3,544,943 | 12/1970 | Hoagland, Jr. . | |
| 3,684,994 | 8/1972 | Tyler . | |
| 3,707,694 | 12/1972 | DuRocher . | |
| 3,725,835 | 4/1973 | Hopkins et al. | 337/382 |
| 3,810,059 | 5/1974 | Jost | 337/140 |
| 3,895,337 | 7/1975 | Osawa | 337/130 |
| 3,906,422 | 9/1975 | Healy . | |
| 4,205,293 | 5/1980 | Melton et al. . | |
| 4,263,573 | 4/1981 | Melton et al. . | |
| 4,371,791 | 2/1983 | Mercier . | |
| 4,462,651 | 7/1984 | McGaffigan . | |
| 4,568,904 | 2/1986 | Takahashi et al. | 337/140 |
| 4,621,882 | 11/1986 | Krumme . | |
| 4,643,500 | 2/1987 | Krumme . | |
| 4,734,047 | 3/1988 | Krumme . | |
| 4,797,649 | 1/1989 | Homma | 337/140 |
| 4,846,729 | 7/1989 | Hikami et al. . | |
| 4,881,908 | 11/1989 | Perry et al. . | |

FOREIGN PATENT DOCUMENTS

WO90/10965 9/1990 WIPO .

*Primary Examiner*—Lincoln Donovan

*Attorney, Agent, or Firm*—Burns, Doane, Swecker & Mathis

[57] ABSTRACT

An over-current/over-temperature protection device (1) which includes first and second electrical contacts (2,3), a separable resistance electrical current path (4) extending between the contacts, a breaker (6) and a heater. The heater comprises the separable path (4). The breaker breaks an electrical connection between at least one of the contacts and the separable path when current above a threshold value passes through the separable path and/or the over-current/over-temperature protection device reaches a threshold temperature. The breaker (6) includes a member of a shape memory alloy which changes shape from a first configuration to a second configuration when the member is heated from a first temperature $T_1$ to a second temperature $T_2$. The heater heats the member from the first temperature $T_1$ to the second temperature $T_2$ so that the member changes from the first configuration to the second configuration. The device can optionally include a permanent resistance electrical current path (5) having a resistance higher than the separable path (4). The device can also include a button (110) for resetting the device or a control circuit for remotely completing or breaking the electrical connection between the separable path and the contacts.

19 Claims, 5 Drawing Sheets

OVER-CURRENT/OVER-TEMPERATURE PROTECTION DEVICE

RELATED APPLICATIONS

This application is a continuation-in-part of U.S. application Ser. No. 07/687,792 filed Apr. 19, 1991, now U.S. Pat. No. 5,105,178.

FIELD OF THE INVENTION

This invention relates to circuit protection devices that limit or shut off current flow in conditions of over-current and/or over-temperature.

DESCRIPTION OF RELATED TECHNOLOGY

Raychem Corporation, Menlo Park, Calif. markets a circuit protection device called a "polyswitch." Raychem's "polyswitch" includes a polymeric material loaded with conductive material, such as carbon particles, which is normally conductive. If the current load increases beyond a predetermined value, the polymer heats up and expands with the result that the conductive particles are separated enough to prevent flow of current through the polymer. A problem with this polymeric type device is that it has an undesirable slow response time due to low thermal conductivity of the polymeric materials. Accordingly, there is a need in the art for a device which quickly changes from a low resistance to a high resistance when an over-current or an over-temperature condition exists.

Another problem with the polymeric device is internal "arcing" which occurs when the current flow is interrupted between adjacent particles. This internal "arcing" leads to breakdown of the polymer and hence limits the upper voltage which can be applied to the device. Accordingly, there is a need in the art for a more reliable switch capable of performing under higher voltage and current conditions.

Another inherent problem of polymeric devices is that the conductivity is relatively low, even in its most conductive state. As a result, high current devices are undesirably large in size when low resistance levels are required.

Ceramic PTC (positive temperature coefficient) devices based on barium titanate perform very similarly to polymeric devices and also display catastrophic breakdown when exposed to elevated voltage and/or current conditions.

Various types of mechanical switching arrangements are known in the art. For instance, U.S. Pat. No. 3,544,943 ("Hoagland") discloses an over-current responsive device which includes a pair of terminals electrically connected together by a thermally responsive element. The thermally responsive element includes two elongated cantilevered members supported at one end to a pair of posts. The posts are electrically connected to the terminals. The first elongated member is electrically insulated from the posts. One end of the second elongated member is welded to a free end of the first member. The second member is also bifurcated into two arms, one arm being electrically connected to one post and the other arm being electrically connected to the other post. Current flows from one terminal, along one arm, then along the other arm to the other terminal. The size, shape, and/or materials of the first and second members are chosen such that the second member is heated and the two members swing in one direction to activate a snap-action switch under overload conditions.

Shape memory alloys have been used in electrical connectors. For instance, U.S. Pat. No. 4,621,882 ("Krumme '882") discloses an electrical connector wherein a first strip which terminates in a split tube is removably connected to a second strip. The split tube includes a shape memory alloy layer which opens or closes the tube. For instance, the tube can include a metal layer which acts as a spring to close the tube when the shape memory layer is in its ductile and soft martensitic state, and the shape memory layer changes shape and overpowers the force of the metal layer when the shape memory layer is heated to its austenitic state. The tube can include a flexible heater for heating the shape memory layer.

U.S. Pat. No. 4,643,500 ("Krumme '500") discloses a multi-contact zero insertion force electrical connector. In a first embodiment, the connector includes a pair of flexible spaced-apart sidewalls, slides having camming surfaces extend along inner surfaces of the sidewalls, pairs of spaced-apart contacts are provided between the sidewalls, upper ends of the contacts are attached to the respective sidewalls by extensions on the sidewalls, and the slides are pushed and pulled by means of a shape memory U-shaped Nitinol (nickel-titanium) wire which extends around the sidewalls with free ends of the wire connected to terminals. To insert a printed circuit board between the sidewalls, current is applied across the terminals to heat the wire to its austenitic state which causes the wire to shrink to a memory state. As a result, the upper portions of the sidewalls are pushed apart by the slides. Upon cooling of the wire, the sidewalls move toward each other and the contacts clamp the circuit board in place.

In another embodiment, Krumme '500 discloses opposed pairs of contacts supported in a body, a U-shaped bail is slidably supported between the contacts, an S-shaped Nitinol member is between the body and the bail, and a pair of leads is connected to the Nitinol member for heating thereof or heating a heater bonded thereto. When the Nitinol member is heated to its austenitic state it expands and pushes up on the bail which in turn pushes the contacts apart. The Nitinol member can be covered with insulation to prevent electrical contact with the contacts.

U.S. Pat. No. 4,734,047 ("Krumme '047") discloses a multi-contact zero insertion force electrical connector. In a heat-to-open embodiment, a plurality of fork-shaped contacts includes distal ends for holding a substrate. A split tube of a shape memory alloy is provided between the distal ends for spreading the distal ends when the alloy is heated to its austenitic state. A spring is concentrically layered with respect to the tube for deforming the tube when the alloy is in its martensitic state. The alloy is heated by a heater located within the tube. Alternatively, in a cool-to-open embodiment, the spring can be provided within the tube, and the contacts are opened by cooling the alloy to its martensitic state whereby the spring expands the tube to spread the distal ends. The spring can be eliminated in the heat-to-open embodiment since the contacts are resilient and will deform the tube when the alloy is in its martensitic state. In addition, the tube can be resistance heated by passing a current therethrough.

U.S. Pat. No. 4,881,908 ("Perry") discloses a connector having a spring in the form of an elongated split tube and a heat-recoverable member of shape memory alloy positioned within the tube. Opposed sets of contact pads are positioned between the ends of the spring and are movable into and out of contact with a substrate inserted between the contact pads. To open the connector, the shape memory alloy is heated by passing a current therethrough or by using a resistance heater circuit or a separate resistance heater. For instance, a heater can be provided between the spring and the shape memory alloy. When the shape memory alloy is in a deformable state below a transition temperature, the spring deforms the shape memory alloy to close the connector. When the shape memory alloy is in a memory state above the transition temperature, the shape memory alloy recovers to its non-deformed state.

SUMMARY OF THE INVENTION

The invention provides an over-current and/or over-temperature protection device which includes first and second electrical contacts, a separable electric current path extending between the contacts, breaker means and heater means. The heater means comprises the separable path which can be a high or low resistance path. The breaker means breaks an electrical connection between at least one of the contacts and the separable path when current above a threshold value passes through the separable path. The breaker means includes a member of a shape memory alloy which changes shape from a first configuration to a second configuration when the member is heated from a first temperature $T_1$ to a second temperature $T_2$. The heater means heats the member from the first temperature $T_1$ to the second temperature $T_2$ so that the member changes from the first configuration to the second configuration.

According to one aspect of the invention, the over-current/over-temperature protection device can be self-resetting. In this case, the over-current/over-temperature protection device includes means for changing the member into the first configuration when the member cools from the second temperature $T_2$ to a third temperature $T_3$ deemed safe for operation of the circuit being protected. The third temperature $T_3$ is below $T_2$ and preferably is at least about 15° C. below $T_2$.

According to another aspect of the invention, the over-current/over-temperature protection device can include means for minimizing arcing when the electrical connection between the separable path and at least one of the contacts is broken by the breaker means. The arc minimizing means comprises a permanent electrical current path extending between the contacts. The permanent path can have a high resistance to flow of electrical current therethrough. The resistance of the permanent path can be any value but typically is at least two times that of the separable path. Any ratio of resistance is attainable between the separable and permanent paths.

The separable and permanent paths can each comprise a flex circuit which includes an electrically conductive layer such as a sputtered metallic or non-metallic conductive film or screen printed conductive ink on a polymer film. The separable and permanent paths can each include a layer of dielectric material on the conductive layer. The dielectric material prevents flow of electrical current from the separable and/or permanent paths to the member while allowing the member to be heated to the second temperature $T_2$ by heat produced by the conductive layer when current flows through the separable and/or permanent paths.

In one embodiment, the contacts have free ends located in an interior space within a housing. The free ends of the contacts are movable from a first position in electrical contact with the separable path to a second position out of electrical contact with the separable path. The contacts are in the first position when the member is in the first configuration, and the contacts are in the second position when the member is in the second configuration. The member can be U-shaped with one free end thereof facing the first contact and another free end thereof facing the second contact. The ends of the U-shaped member can be closer together in the first configuration than in the second configuration. The contacts can be spring loaded such that the contacts return to the first position when the member changes from the second configuration to the first configuration. The housing can include first, second and third support surfaces in the interior space. The first support surface can be arcuate and face a central portion of the polymer film of the separable path. The second and third surfaces can be opposite sides of a wall. The second support surface can be attached to one end of the polymer film, and the third support surface can be attached to an opposite end of the polymer film. The U-shaped member can be supported between the polymer films of the separable and permanent paths.

In another embodiment, the contacts include contact zones which are immovable with respect to each other. The separable path has free ends which are movable from a first position in electrical contact with the contact zones to a second position out of electrical contact with the contact zones. The free ends of the separable path are in the first position when the member is in the first configuration, and the free ends of the separable path are in the second position when the member is in the second configuration.

The member can be U-shaped, and the contact zones can be located between free ends of the U-shaped member. The free ends of the U-shaped member can be closer together in the first configuration than in the second configuration. A spring can be provided for biasing the free ends of the separable path in the first position. The spring can comprise a bent strip having an arcuate central portion and inwardly curved end sections extending from the central portion. Each free end of the separable path can be attached to a respective end section of the spring. The spring biases the free ends of the separable path toward the contacts so that the separable path is in electrical contact with the contact zones when the U-shaped member is in its first configuration. The U-shaped member bends the end sections of the spring outwardly away from the contact zones when the U-shaped member is in the second configuration.

The housing can include first, second and third support surfaces within the interior space. The first contact zone can be attached to the first support surface. The second contact zone can be attached to the second support surface. The permanent path can be attached to the third support surface. The first and second support surfaces can comprise opposite sides of a wall extending from a base of the housing and into a center of the interior space. The first contact zone can comprise a conductive layer on the first support surface, the second contact zone can comprise a conductive layer on the second support surface, and the polymer film of the permanent path can be adhesively bonded to the third support surface. The third support surface can be convex in cross-section and face a concave portion of the U-shaped member. The housing can include a pair of leads on an exterior surface thereof, and the leads can be electrically connected to the contact zones.

BRIEF DESCRIPTION OF THE DRAWING

The invention is described with reference to the attached drawing, in which.

DETAILED DESCRIPTION OF THE PREFERRED EMBODIMENTS

The invention provides an over-current/over-temperature protection device which interrupts flow of electrical current between two contacts in response to either an over-current and/or over-temperature condition. The over-current/over-temperature protection device can be designed to meet the needs of a wide variety of electrical circuits. In particular, the over-current/over-temperature protection device can be designed to rapidly break an electrical connection in response to a current or temperature overload condition.

The over-current/over-temperature protection device includes first and second electrical contacts, a separable electrical current path extending between the contacts, breaker means and heater means. The heater means comprises the separable path. The breaker means breaks an electrical connection between at least one of the contacts and the separable path when current above a threshold value passes through the separable path. The breaker means includes a member made of shape memory alloy such as NiTi which changes shape from a first configuration to a second configuration when the member is heated from a first temperature $T_1$ to a second temperature $T_2$. The heater means heats the member from the first temperature $T_1$ to the second temperature $T_2$ so that the member changes from the first configuration to the second configuration.

According to one aspect of the invention, the over-current/over-temperature protection device can be self-resetting. In this case, the over-current/over-temperature protection device includes means for changing the member back into the first configuration when the member cools from the second temperature $T_2$ to a third temperature $T_3$ deemed safe for current operations, typically about 15° C. below $T_2$.

According to another aspect of the invention, the over-current/over-temperature protection device can include means for minimizing arcing when the electrical connection between the separable path and at least one of the contacts is broken by the breaker means. The arc minimizing means comprises a permanent electrical current path extending between the contacts, the permanent path having a high resistance to flow of electrical current therethrough. The resistance of the high resistance path can be any value. For instance, the resistance of the permanent path can be two times or more than that of the separable path. Virtually any ratio of resistances between the separable and permanent paths can be used depending upon specific circuit needs.

Figure 1:
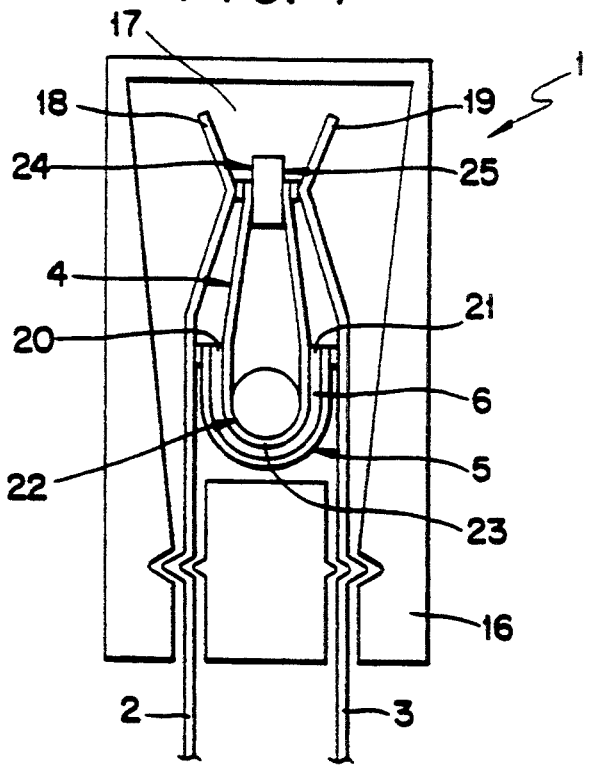
FIG. 1 shows a cross-section of a self-resetting over-current/over-temperature protection device in accordance with one embodiment of the invention.

A first embodiment of the over-current/over-temperature protection device of the invention is shown in FIG. 1. The over-current/over-temperature protection device includes first and second electrical contacts, a separable electrical current path extending between the contacts, breaker means and heater means. The heater means comprises the separable path. The breaker means breaks an electrical connection between the separable path and at least one of the contacts when current above a threshold value passes between the contacts through the separable path. The breaker means includes a member made of a shape memory alloy which changes shape from a first configuration to a second configuration when the member is heated from a first temperature $T_1$ to a second temperature $T_2$. The heater means heats the member from the first temperature $T_1$ to the second temperature $T_2$ so that the member changes from the first configuration to the second configuration.

The over-current/over-temperature protection device can be made self-resetting by providing means to reset the contacts and the member to their original positions. This can be accomplished by making the contacts from a spring material and biasing them together. Alternatively, the over-current/over-temperature protection device can be manually resettable by suitable means.

The over-current/over-temperature protection device can also include means to minimize arcing when the electrical connection between the separable path and the contacts is broken. The arc minimizing means comprises a permanent resistance electrical current path that remains continuous (i.e., unbroken) whether the separable path is or is not in electrical contact with both of the contacts. The permanent path can also provide enough heat to the member to maintain it in its second configuration until the over-current and/or over-temperature condition is relieved or removed.

The over-current/over-temperature protection device shown generally at 1 in FIG. 1 includes first and second electrical contacts 2,3. Separable electrical current path 4 extends between contacts 2,3, and permanent electrical current path 5 extends between contacts 2,3. Breaker means shown as member 6 breaks an electrical connection between at least one contact 2,3 and separable path 4 when current above a threshold value flows through separable path 4 and/or permanent path 5.

The breaker means comprises member 6 made of a shape memory alloy such as a strip of Ni—Ti which changes shape from a first bent configuration to a second less bent configuration when member 6 is heated from first temperature $T_1$ to second temperature $T_2$. Separable path 4 and/or permanent path 5 perform an additional function of heating member 6 from first temperature $T_1$ to second temperature $T_2$ when current above the threshold value flows through separable path 4 and/or permanent path 5. As a result, member 6 changes shape from the more bent configuration to the less bent configuration and forces contacts 2,3 to spread apart so as to be out of contact with separable path 4.

Permanent path 5 minimizes arcing when the electrical connection between contacts 2,3 and separable path 4 is broken by member 6. That is, permanent path 5 provides an alternative path for flow of electrical current between contacts 2,3. The ratio of the resistance of permanent path 5 to that of Separable path 4 can be set at any arbitrary value such as 2:1, 50:1, 100:1, 250:1, 500:1, 1000:1, etc. For instance, the resistance of separable path 4 could be 1 ohm, and the resistance of permanent path 5 could be 100 ohms or higher. In addition to minimizing arcing, permanent path 5 continues to provide an adequate heating effect to maintain the device in its "open" or "tripped" condition until the over-current and/or over-temperature condition causing triggering of the device is relieved or removed.

Figure 2:
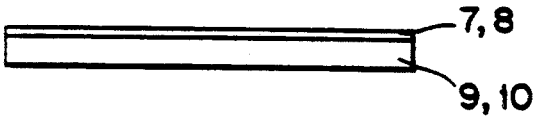
FIG. 2 shows a side view of a resistance electrical current path usable in the over-current/over-temperature protection device of the invention.
Figure 3:
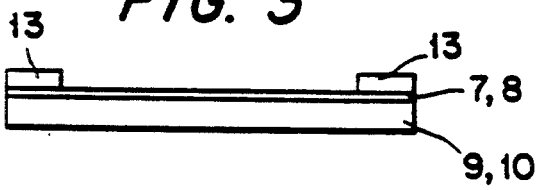
FIG. 3 shows a side view of the resistance path shown in FIG. 2 with contact pads thereon.

To manufacture separable path 4, electrically conductive layer 7 is deposited on polymer film 9, as shown in FIG. 2. Likewise, permanent path 5 can be manufactured by depositing electrically conductive layer 8 on polymer film 10. Conductive layer 8, however, preferably has a higher electrical resistance than layer 7. The higher resistance of layer 8 can be obtained in various ways. For instance, if layers 7,8 comprise the same material and are deposited in the same thickness, permanent path 5 could comprise a more narrow strip of composite 8,10 than composite 7,9. That is, the wider strip comprising separable path 4 can have a greater area over which the current flows and thus lower resistance to the flow of current therethrough compared to permanent path 5.

As an example, polymer film 10 can comprise a polyimide film which is 0.0005 to 0.001 inch (0.0127 to 0.0254 mm) thick and 0.075 inch (1.905 mm) wide. Conductive layer 8 can comprise a nichrome sputtered deposit on polymer film 10. The thickness of nichrome layer 8 can be adjusted in accordance with the desired resistance of the permanent path 5. For instance, the thickness of nichrome layer 8 can be adjusted to provide a resistance of 1000 ohms. Separable path 4 can comprise a polyimide film 9 which is 0.0005 to 0.001 inch (0.0127 to 0.0254 mm) thick and 0.05 inch (1.27 mm) wide with a nichrome or copper layer 7 thereon in a thickness to provide a desired resistance such as 1 ohm. Accordingly, various materials and dimensions (length, width, thickness) can be utilized in designing separable and permanent paths 4,5.

Figure 4:
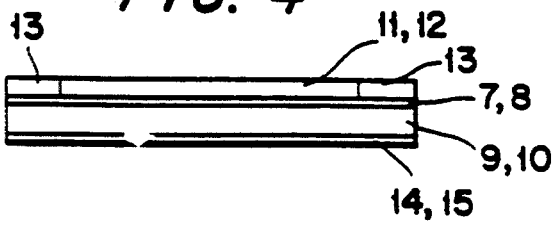
FIG. 4 shows a side view of the resistance path shown in FIG. 3 with a dielectric layer and an adhesive layer thereon.

Separable and permanent paths 4,5 can be used with or without one or more electrically insulating coatings. However, to prevent leakage of current to surrounding electrically conducting materials, paths 4,5 can be provided with a coating of dielectric material. For instance, separable path 4 can include layer 11 of dielectric material on conductive layer 7, as shown in FIG. 4. Likewise, permanent path 5 can include layer 12 of dielectric material on conductive layer 8. The dielectric material can comprise any suitable electrically insulating material such as polymer or ceramic materials.

Figure 5:
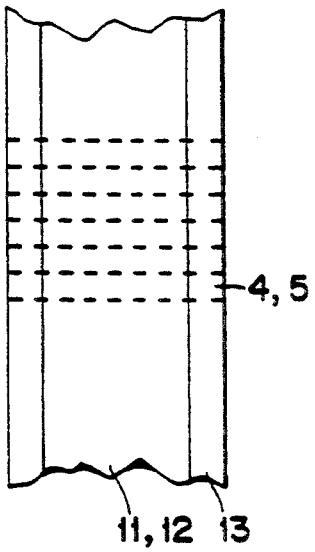
FIG. 5 shows a top view of a ribbon which can be cut to provide a plurality of resistance paths usable in the over-current/over-temperature protection device of the invention.

The dielectric material 11,12 can be applied in any suitable manner such as by techniques conventionally used in semiconductor processing. For example, a sheet of polymer film 9,10 of polyimide having a metallic layer of nichrome 7,8 can be masked off, and dielectric layer 11,12 can be deposited on the nichrome layer 7,8 in a desirable pattern. The article shown in FIG. 5 comprises a ribbon cut from such a sheet of polyimide 9,10 having nichrome layer 7,8 and dielectric layer 11,12 thereon. Separable paths 4 can comprise strips cut from the ribbon shown in FIG. 5. Likewise, permanent paths 5 can comprise more narrow strips cut from the same or a similar ribbon.

Separable and permanent paths 4,5 can be used with or without contact pads. However, to provide for optimized current flow into and out of paths 4,5, pads 13 of an electrically conducting corrosion resistant material can be provided on conductive layers 7,8. For instance, pads 13 can comprise a layered structure of copper, nickel, gold, etc. Or, for instance, pads 13 could comprise a single layer of copper with tin-lead solder plating over the copper layer.

To form pads 13, the metal or metals of the pad can be plated on conductive layers 7,8. For instance, if dielectric layer 11,12 is already present, the metal or metals of pads 13 can be plated directly on conductive layers 7,8.

As shown in FIG. 1, member 6 is surrounded on both sides by paths 4,5. Dielectric layer 11 on separable path 4 faces and/or contacts member 6 and prevents flow of electrical current from separable path 4 to member 6 while allowing member 6 to be heated to second temperature $T_2$ by heat produced by conductive layer 7 when current above a threshold value $I_c$ flows through separable path 4. Dielectric layer 12 can be in contact with member 6 to prevent flow of electrical current from permanent path 5 to member 6. Paths 4,5 can be used with or without adhesive means thereon. However, to provide for attachment to other parts, paths 4,5 can include adhesive layers 14,15. For instance, polymer film 9 can include adhesive layer 14 on one side and conductive layer 7 on the other side thereof, as shown in FIG. 4. Likewise, polymer film 10 can include adhesive layer 15 on one side and conductive layer 8 on the other side thereof. Additional adhesive layers could be provided on dielectric layers 11,12, if desired.

In the embodiment shown in FIG. 1, housing 16 includes interior space 17 within which contacts 2,3, paths 4,5 and member 6 are located. Housing 16 can be extremely small in size with an overall height of about 0.5 inch (12.7 mm) and a width of less than 0.5 inch (12.7 mm), for example. Of course, the principles of the invention can be applied to larger or smaller devices.

Contacts 2,3 have free ends 18,19 thereof within interior space 17. Free ends 18,19 are movable from a first position in electrical contact with separable path 4 (as shown in FIG. 1) to a second position (not shown) out of electrical contact with separable path 4. Free ends 18,19 are in the first position when member 6 is in its first configuration, and free ends 18,19 are in the second position when member 6 is in its second configuration.

Member 6 can be U-shaped in the first and second configurations with one free end 20 facing first contact 2 and another free end 21 facing second contact 3. Free ends 20,21 are closer together when member 6 is in its first configuration than when member 6 is in its second configuration. Member 6 can comprise a rectilinearly extending strip which is bent into a U-shape in its easily deformed martensitic condition at first temperature $T_1$. When heated to second temperature $T_2$, member 6 changes into its austenitic state and attempts to revert to its memorized flat condition thereby causing free ends 20,21 to spread apart and force free ends 18,19 of contacts 2,3 away from each other.

Contacts 2,3 can be of an elastic or springy material such as beryllium-copper (Be—Cu). In the arrangement shown in FIG. 1, contacts 2,3 include U-shaped bends which are received in corresponding U-shaped grooves in housing 16. This arrangement holds contacts 2,3 in a precise relationship to each other and such that they are spring loaded. Spring loaded contacts 2,3 return to the first position when member 6 changes from the second configuration to the first configuration. As explained earlier, member 6 is easily deformed at the first temperature $T_2$ since it is in its martensitic condition. As such, spring loaded contacts 2,3 bend member 6 into its first configuration when member 6 cools from second temperature $T_2$ to a lower temperature $T_3$ such as about 15° C. lower than $T_2$. Alternatively, contacts 2,3 can be spring loaded so as to be biased toward each other by other suitable means such as a spring(s), elastomeric material, or other mechanical equivalent.

As shown in FIG. 1, housing 16 can include arcuate support surface 22 in interior space 17. Central portion 23 of separable path 4 extends around surface 22. Surface 22 can face polymer film 9 of separable path 4. To secure separable path 4 in position, adhesive layer 14 can be used to attach polymer film 9 to surface 22.

Housing 16 can include support surfaces 24,25 to which opposite ends of separable path 4 are attached. In the arrangement shown in FIG. 1, surfaces 24,25 are spaced apart and face in opposite directions. One end of separable path 4 can be attached to surface 24 by means of adhesive layer 14, and the opposite end of separable path 4 can be attached to surface 25 by adhesive layer 14.

Figure 6:
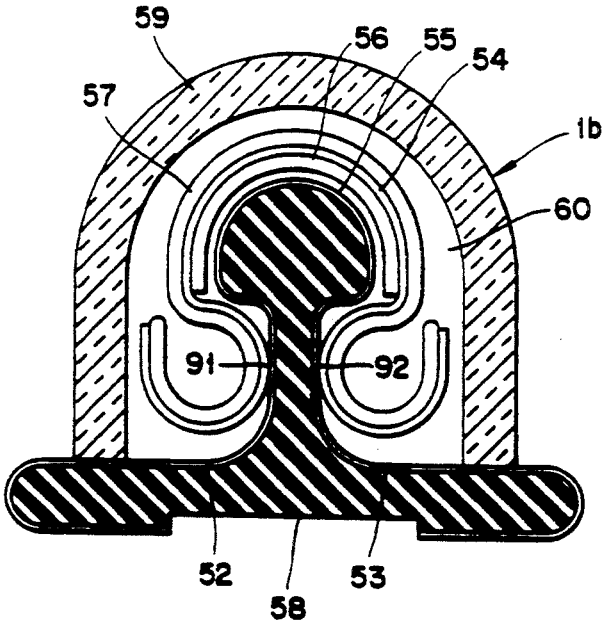
FIG. 6 shows a self-resetting over-current/over-temperature protection device in accordance with a second embodiment of the invention.
Figure 7:
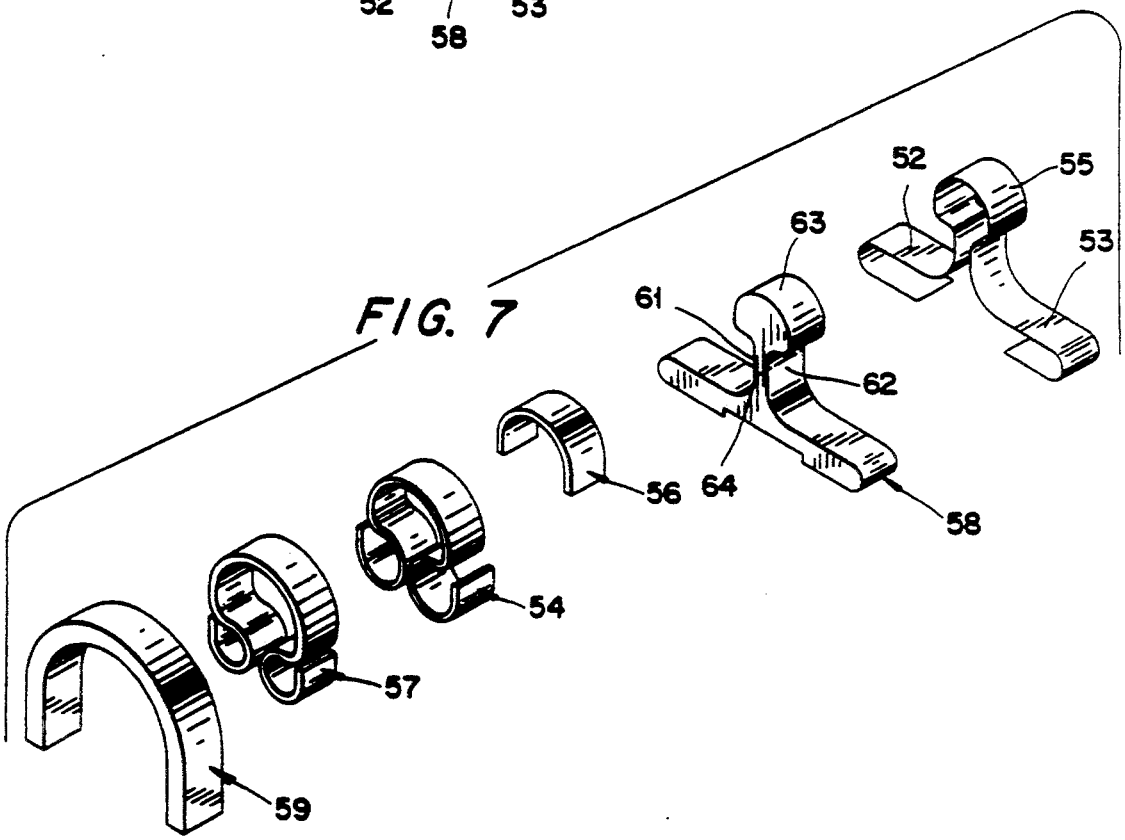
FIG. 7 shows a perspective exploded view of various parts; of the arrangement shown in FIG. 6.

A second embodiment of the invention is shown in FIGS. 6–7. In this embodiment, over-current/over-temperature protection device 1b includes contacts 52,53 which have contact zones located in interior space 60 within a housing. Contacts 52,53 are immovable with respect to each other, and permanent path 55 provides a non-separable high resistance electrical path between contacts 52 and 53. Separable resistance current path 54 has contact zones 91,92 which are movable from a first position (as shown in FIG. 6) in electrical contact with contact zones of contacts 52,53 to a second position out of electrical contact therewith. Contact zones 91,92 are in the first position when member 56 is in a first configuration (as shown in FIG. 6), and contact zones 91,92 are in the second position when member 56 is in a second configuration. Separable path 54 preferably has a lower resistance than permanent path 55.

Spring 57 is provided for biasing the contact zones 91,92 of separable path 54 in the first position. Spring 57 comprises an elastic strip having an arcuate central portion and ring-shaped end sections extending inwardly from the central portion. Contact zones 91,92 of separable path 54 are attached to the respective end sections of spring 57. Spring 57 biases contact zones 91,92 of separable path 54 toward the contact zones of contacts 52,53 so that separable path 54 is in electrical contact with contacts 52,53 when the U-shaped member 56 is in its first configuration. U-shaped member 56 bends the end sections of spring 57 outwardly away from the contact zones of contacts 52,53 when U-shaped member 56 is heated from a first temperature $T_1$ to a second temperature $T_2$ to change member 56 into the second configuration.

A housing of the over-current/over-temperature protection device includes base 58 and cover 59. Base 58 includes first, second and third support surfaces 61–63 within interior space 60. The contact zone of first contact 52 is attached to first support surface 61. The contact zone of second contact 53 is attached to second support surface 62. Permanent path 55 is attached to third support surface 63. First and second support surfaces 61,62 comprise opposite sides of wall 64 extending from base 58 and into the center of interior space 60 within cover 59. Surface 63 comprises an outer surface of an enlargement extending from one end of wall 64. First contact 52 can comprise a copper plating, second contact 53 can comprise another copper plating and permanent path 55 can comprise a nichrome film on a single strip of polymer film. Alternatively, contacts 52,53 and permanent path 55 can comprise coterminous metal layers on a polymer film. For instance, contacts 52,53 and permanent path 55 can comprise a polymer film with coterminous metallic layers on one side thereof. The metallic layers can include a metallic layer such as nichrome on a central portion of the polymer film and metallic layers such as copper on ends of the polymer film. In this case, the central metallic layer comprises permanent path 55, and the other metallic layers comprise contacts 52,53. The polymer film can include adhesive to attach the film to surfaces 61–63.

In cases where the over-current/over-temperature protection device is not automatically resettable, the over-current/over-temperature protection device can include a manually resettable mechanism. For example, a movable button extending through an upper part of the housing can be provided for pushing the spring and shape memory alloy member back into configurations in which separable path 54 is in contact with the contact zones of contacts 52,53. In this case, the over-current-/over-temperature protection device shown in FIG. 6 can include biasing means such as a pair of springs urging the respective end sections of spring 57 away from base 58 and toward an upper part of cover 59. When member 56 is in its first configuration, however, contact zones 91,92 of separable path 54 tightly grip the contact zones of contacts 52,53 by friction, thus preventing spring 57 from moving upwardly along wall 64 due to the force of the biasing means. When an over-current/over-temperature condition exits, contact zones 91,92 move away from the contact zones of contacts 52,53. As a result, the biasing means pushes spring 57 upwardly. Cover 59 can include a suitably shaped recess for receiving the reset button such that the button extends only out of cover 59 when spring 57 is moved upwardly due to an over-current/over-temperature condition. Once the over-current/over-temperature condition no longer exits, member 56 will cool and transform to its martensitic condition thereby allowing spring 57 to press against opposite sides of wall 64 when the button is depressed.

Figure 9:
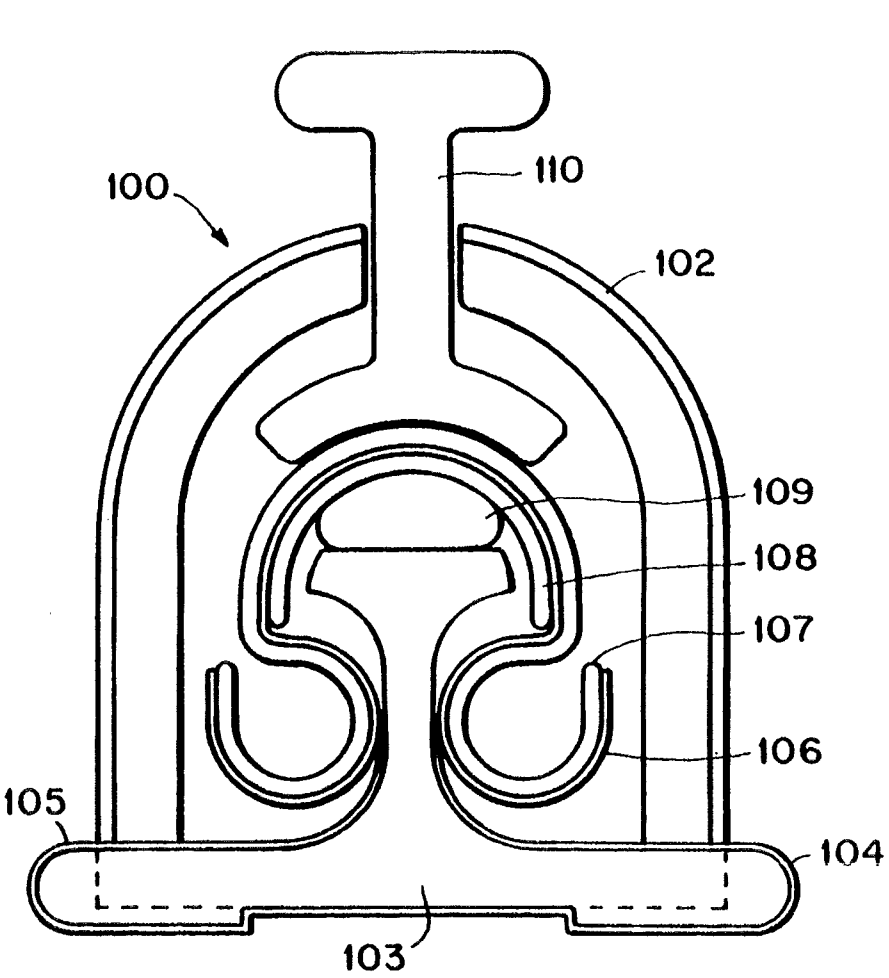
FIG. 9 shows a cross-section of the device shown in FIG. 8 wherein the current path has been manually reset.
Figure 8:
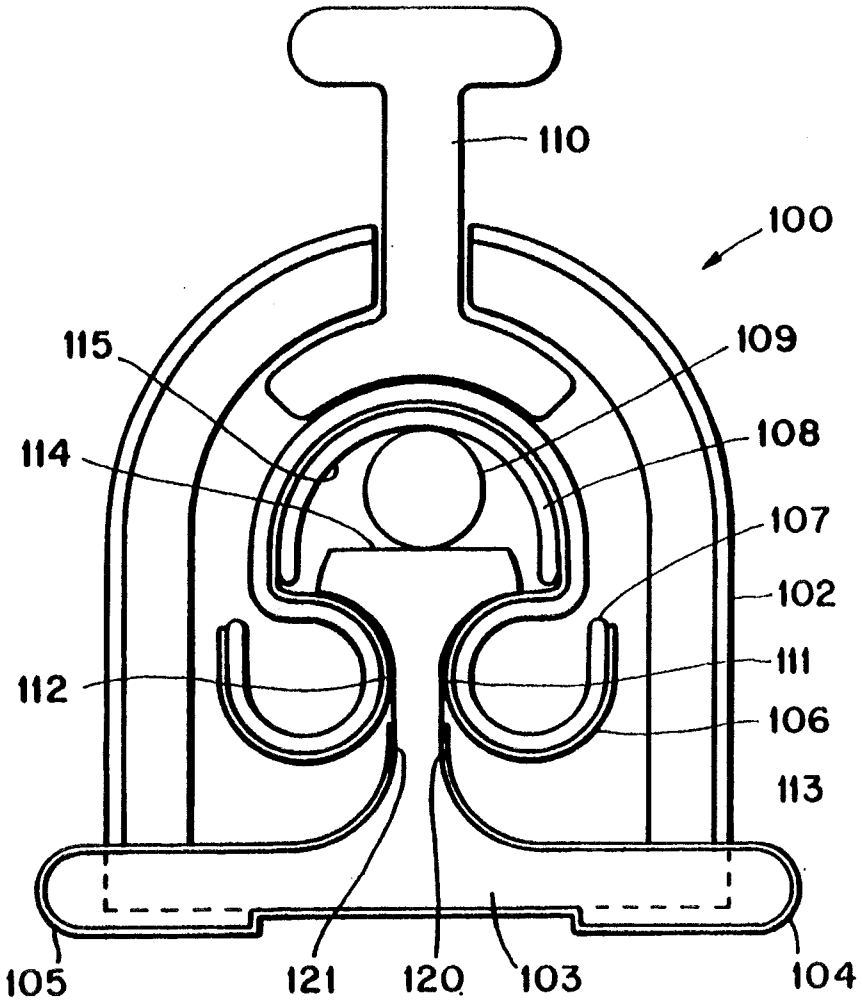
FIG. 8 shows a cross-section of a manually resettable over-current/over-temperature protection device in accordance with a third embodiment of the invention wherein a current path has been broken.

A third embodiment of the over-current/over-temperature protection device of the invention is shown in FIGS. 8 and 9. The over-current/over-temperature protection device is manually resettable and includes first and second electrical contacts, a separable electrical current path extending between the contacts, breaker means, heater means and resettable means. The heater means comprises the separable path. The breaker means breaks an electrical connection between the separable path and at least one of the contacts when current above a threshold value passes between the contacts through the separable path. The breaker means includes a member made of a shape memory alloy which, if unrestrained, changes shape from a first configuration to a second configuration when the member is heated from a first temperature $T_1$ to a second temperature $T_2$. The heater means heats the member from the first temperature $T_1$ to the second temperature $T_2$ so that the member undergoes a metallurgical phase change wherein the member attempts to assume a memorized shape.

Manually resettable over-current/over-temperature protection device 100 includes housing 102, base 103, and first and second electrical contacts 104,105. Separable electrical current path 106 extends between contacts 104,105. Breaker means 108 breaks an electrical connection between at least one contact 104,105 and separable path 106 when current above a threshold value flows through separable path 106.

Breaker means 108 is made of a shape memory alloy such as a strip of Ni—Ti which undergoes a metallurgical phase change which causes the breaker means 108 to attempt to change shape from a first bent configuration to a second less bent configuration when breaker means 108 is heated from first temperature $T_1$ to second temperature $T_2$. For instance, breaker means 108 can be a strip having a memorized flat shape. In its martensitic condition at $T_1$, the strip can be easily deformed into a first bent shape. However, when the strip is heated so as to be in its austenitic condition at $T_2$, the strip attempts to straighten out into the memorized flat shape.

Separable path 106 performs an additional function of heating breaker means 108 from first temperature $T_1$ to second temperature $T_2$ when current above the threshold value flows through separable path 106. As a result, breaker means 108, if unrestrained, changes shape from the more bent configuration to the less bent configuration.

Figure 12:
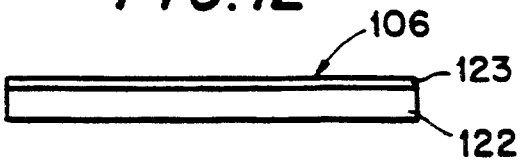
FIG. 12 shows a side view of a resistance electrical current path usable in the over-current/over-temperature protection device of the invention.

To manufacture separable path 106, electrically conductive layer 123 can be deposited on polyimide/polymer film 122, as shown in FIG. 12. For instance, separable path 106 can comprise a polyimide film 122 which is 0.0005 to 0.001 inch (0.0127 to 0.0254 mm) thick and 0.05 inch (1.27 mm) wide with a nichrome or copper layer 123 thereon in a thickness to provide a desired resistance such as 1 ohm. However, various materials and dimensions (length, width, thickness) can be utilized in designing separable path 106.

Figure 14:
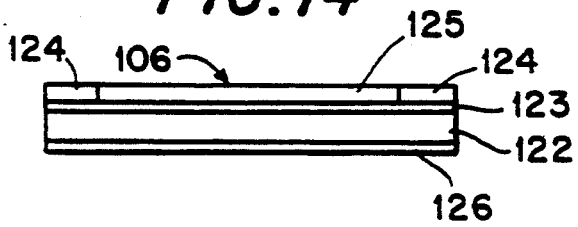
FIG. 14 shows a side view of the resistance path shown in FIG. 13 with a dielectric layer and an adhesive layer thereon.

Separable path 106 can be used with or without one or more electrically insulating coatings. However, to prevent leakage of current to surrounding electrically conducting materials, path 106 can be provided with a coating of dielectric material. For instance, separable path 106 can include layer 125 of dielectric material on conductive layer 123, as shown in FIG. 14. The dielectric material can comprise any suitable electrically insulating material such as polymer or ceramic materials.

Figure 15:
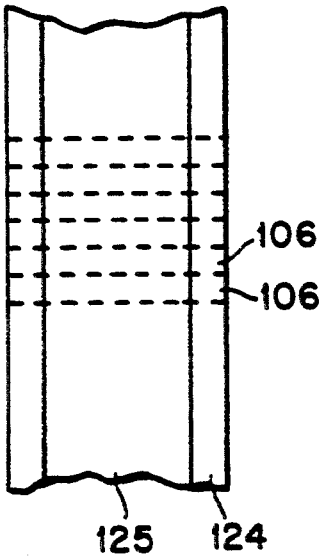
FIG. 15 shows a top view of a ribbon which can be cut to provide a plurality of resistance paths usable in the over-current/over-temperature protection device of the invention.

The dielectric material 125 can be applied in any suitable manner such as by techniques conventionally used in semiconductor processing. For example, a sheet of polyimide film 122 having a metallic layer of nichrome or copper 123 can be masked off, and dielectric layer 125 can be deposited on the polyimide film 122 in a desirable pattern. Alternatively, the conductive layer 123 can be etched to provide the desired pattern on the polyimide film 122. The article shown in FIG. 15 comprises a ribbon cut from such a sheet of polyimide film 122 having conductive layer 123 and dielectric layer 125 thereon. Separable path 106 can comprise a single strip cut from the ribbon shown in FIG. 15.

Separable path 106 can be used with or without contact pads. However, to provide for optimized current flow into and out of path 106, pads 124 of an electrically conducting corrosion resistant material can be provided on conductive layer 123. For instance, pads 124 can comprise a layered structure of copper, nickel, gold, etc. Pads 124 could also comprise a single layer of copper, with tin-lead solder plating over the copper layer.

Figure 13:
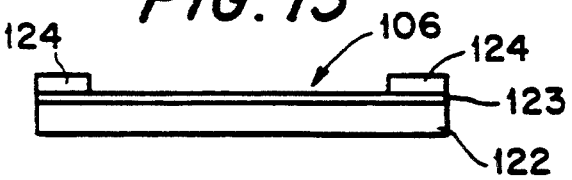
FIG. 13 shows a side view of the resistance path shown in FIG. 12 with contact pads thereon.

To form pads 124, the metal or metals of the pad can be plated on conductive layer 123, as shown in FIG. 13. For instance, if dielectric layer 125 is already present, the metal or metals of pads 124 can be plated directly on conductive layer 123.

As shown in FIG. 8, breaker means 108 is located on one side of path 106. Dielectric layer 125 on separable path 106 faces and/or contacts breaker means 108 and prevents flow of electrical current from separable path 106 to breaker means 108 while allowing breaker means 108 to be heated to second temperature $T_2$ by heat produced by conductive layer 123 when current above a threshold value $I_c$ flows through separable path 106. Path 106 can be used with or without adhesive means thereon. However, to provide for attachment to other parts, path 106 can include adhesive layer 126. For instance, polymer film 122 can include adhesive layer 126 on one side and conductive layer 123 on the other side thereof, as shown in FIG. 14. Additional adhesive layers could be provided on dielectric layer 125, if desired.

As shown in FIGS. 8 and 9, contacts 104,105 are immovable and have contact zones located in interior space 113 within housing 102. Separable path 106 has contact zones 111,112 which are movable from a first position (as shown in FIG. 8) in electrical contact with contact zones of contacts 104,105 to a second position (as shown in FIG. 9) out of electrical contact therewith. Contact zones 111,112 are in the first position when breaker means 108 is at the first temperature $T_1$, and contact zones 111,112 are in the second position when breaker means 108 is at the second temperature $T_2$.

Spring 107 normally urges contact zones 111, 112 into contact with contacts 104,105. In particular, spring 107 comprises an elastic strip having an arcuate central portion and ring-shaped end sections extending inwardly from the central portion. Contact zones 111,112 of separable path 106 are attached, such as by adhesive 126, to the respective end sections of spring 107. Spring 107 thus provides a force which biases contact zones 111,112 of separable path 106 toward the contact zones of contacts 104,105 so that separable path 106 is in electrical contact with contacts 104,105 when U-shaped breaker means 108 is at the first temperature $T_1$. U-shaped breaker means 108 provides a force which tends to bend the end sections of spring 107 outwardly away from the contact zones of contacts 104,105 when U-shaped breaker means 108 is heated from the first temperature T, to the second temperature $T_2$, i.e., when breaker means 108 undergoes a metallurgical phase change and attempts to revert to a memorized shape. As a result, the gripping force acting on contact zones 111,112 is relieved enough to allow tube spring 109 to overcome the force of spring 107, i.e., tube spring 109 slides contact zones 111,112 rectilinearly until they are out of contact with contacts 104,105, as shown in FIG. 8.

Base 103 includes first, second and third support surfaces 120, 121 and 114 within interior space 113. Contact zone 111 of first contact 104 is attached to first support surface 120. Contact zone 112 of second contact 105 is attached to second support surface 121. Tube spring 109 is supported on third support surface 114. First and second support surfaces 120,121 comprise opposite sides of a vertical wall which extends from base 103 into the center of interior space 113. Surface 114 comprises an upper surface of an enlargement on top of the vertical wall. Contacts 104,105 can comprise copper platings on base 103 or a patterned copper plating on a single strip of polymer film. Alternatively, contacts 104,105 can comprise separate polymer films with a metallic layer on one side thereof. The polymer film can include adhesive to attach the film to surfaces 120,121.

Tube spring 109 is elastically deformed in the non-circular shape shown in FIG. 9 when separable path 106 is in electrical contact with contacts 104,105. However, when breaker means 108 is heated to the second temperature $T_2$, it provides enough of a counter force against the action of spring 107 to weaken the grip of contact zones 111,112 on contacts 104,105 and allow tube spring 109 to change to a circular shape, as shown in FIG. 8. Thus, the assembly of path 106, spring 107 and breaker means 108 is pushed by contact with the inside surface 115 of breaker means 108 by tube spring 109 toward the top of housing 102 and results in a wiping action of contact zones 111,112 on contacts 104,105.

Over-current/over-temperature protection device 100 includes a manually resettable mechanism. In particular, movable button 110 extends through an upper part of housing 102 and includes a portion inside housing 102 for pushing spring 107 and shape memory alloy breaker means 108 back into a position at which separable path 106 is in contact with the contact zones of contacts 104,105. When breaker means 108 is in its martensitic state at the first temperature $T_1$, the force of spring 107 overcomes the force of breaker means 108, and contact zones 111,112 of separable path 106 stay in electrical contact with contact zones of contacts 104,105. When an over-current/over-temperature condition exits, tube spring 109 is able to overcome the force of spring 107 since breaker means 108 changes to its austenitic state and attempts to return to the memorized shape thereby weakening the force of spring 107. As a result, contact zones 111,112 slide along contacts 104,105 until the separable path 106 is no longer in electrical contact with contacts 104,105. Once the over-current/over-temperature condition no longer exits, breaker means 108 will cool and transform to its martensitic condition thereby allowing spring 107 to apply greater force against opposite sides of the vertical wall. The device can then be reset by pushing down on button 110, thereby returning tube spring 109 to the non-circular configuration shown in FIG. 9.

Figure 10:
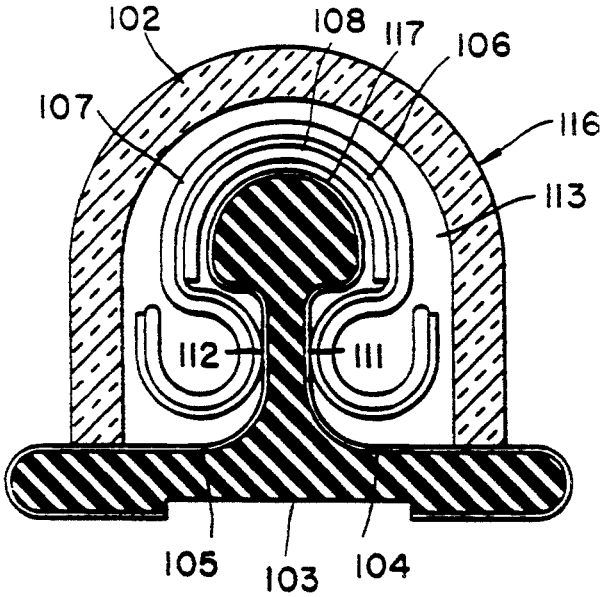
FIG. 10 shows a cross-section of a remotely resettable over-current/over-temperature protection device in accordance with a fourth embodiment of the invention.
Figure 11:
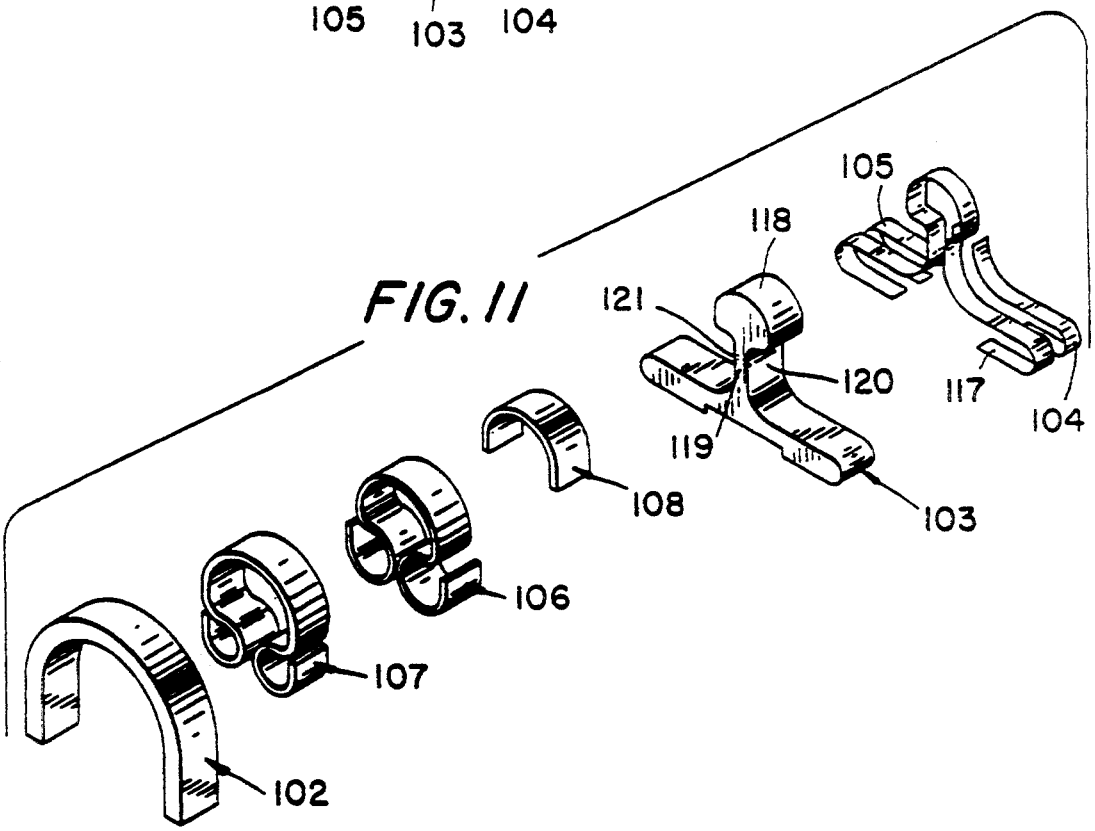
FIG. 11 shows a perspective exploded view of various parts of the arrangement shown in FIG. 10.

A fourth embodiment of the over-current/over-temperature protection device of the invention is shown in FIGS. 10 and 11. In particular, device 116 is similar to device 100 except that it includes remotely controlled resettable means. With respect to other features, like parts are identified with the same numerals as are used in FIGS. 8 and 9.

In the embodiment shown in FIGS. 10 and 11, breaker means 108 changes from a first bent configuration in its martensitic state to a second less bent configuration in its austenitic state when heated from the first temperature $T_1$ to the second temperature $T_2$. As a result, spring 107 is expanded such that contact zones 111,112 move out of contact with contacts 104,105. When breaker means 108 cools sufficiently to transform to its martensitic state, the force of spring 107 bends breaker means 108 until contact zones 111,112 are brought back into contact with contacts 104,105, as in the second embodiment of the invention.

Remotely controlled device 116 includes control circuit path 117 which is electrically insulated from contacts 104,105 and extends over surface 118 on top of vertical wall 119 extending upwardly from base 103, as shown in the exploded view in FIG. 11. Surface 118 is complementary to the concave surface of breaker means 108. When current above the threshold value $I_c$ is supplied from a remote source to control path 117, control path 117 heats breaker means 108 to the second temperature $T_2$. As a result, breaker means 108 transforms to its austenitic state in a remotely controlled manner. Breaker means 108 can also be heated to temperature $T_2$ by an over-temperature condition or an over-current passing through separable path 106.

Figure 16:
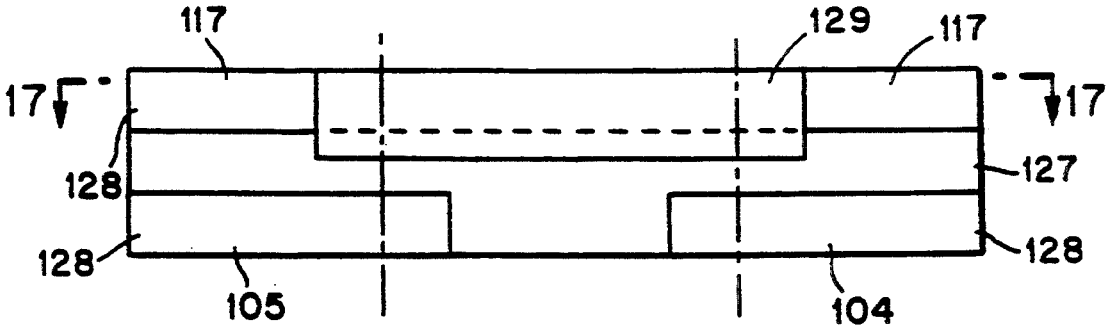
FIG. 16 shows a top view of the control current path and the contacts of the self-resetting over-current/over-temperature protection device in accordance with a second embodiment of the invention.
Figure 17:
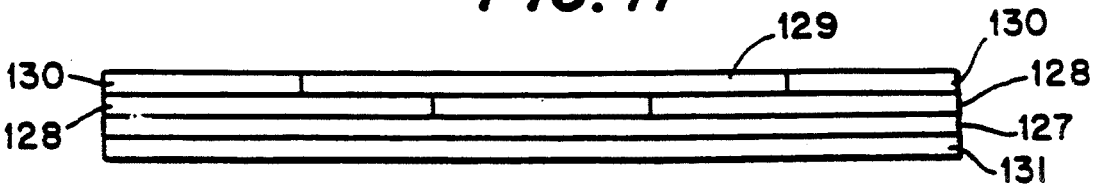
FIG. 17 shows a side view taken along the line 17—17 in FIG. 16.

As shown in FIGS. 16 and 17, control path 117 and contacts 104,105 can be provided on a polymer film 127 by the technique described earlier for making paths 4, 5 and 106. For instance, electrically conductive layer 128 such as copper can be deposited on polymer film 127, and layer 128 can be etched in a desirable pattern such as the pattern of electrically conductive layer 128 shown in FIG. 16. Then dielectric layer 129 can be provided on a central portion of the layer 128 corresponding to control path 117 to electrically insulate control path 117 from breaker means 108. That is, dielectric layer 129 will be located between control path 117 and the concave surface of breaker means 108. Dielectric layer 129 should also cover enough of control path 117 to prevent electrical contact between contact zones 111,112 and control path 117. To compensate for the increased height on layer 128 added by dielectric layer 129, contacts 104,105 can be made thicker by building up electrically conductive layers 130 on layers 128 so that separable path 106 makes good electrical contact with contacts 104,105. For attachment purposes, the composite shown in FIGS. 16 and 17 can be provided with adhesive layer 131. That is, adhesive layer 131 can be used to secure the composite (104, 105, 117) to base 103 such that control path 117 extends over surfaces 120, 118 and 121.

While the invention has been described with reference to the foregoing embodiments, various changes and modifications can be made to the invention which fall within the scope of the appended claims.

What is claimed is:

1. An over-current/over-temperature protection device, comprising:

first and second electrical contacts;

a separable resistance electrical current path forming an electrical connection between the contacts, the separable path having a resistance to flow of electrical current therethrough, the separable path comprising an electrically conductive layer on a polymer film;

breaker means for preventing flow of electrical current between the contacts through the separable path when current above a threshold value flows through the separable path and/or the over-current/over-temperature protection device reaches a threshold temperature, the means comprising a member of a shape memory alloy which undergoes a metallurgical phase change when heated from a first temperature $T_1$ to a second temperature $T_2$, the member when unrestrained being capable of changing from a first configuration into a second configuration when heated from the first temperature $T_1$ to the second temperature $T_2$, the separable path being separated from at least one of the contacts when the member is heated to the second temperature $T_2$;

heater means for heating the member from the first temperature $T_1$ to the second temperature $T_2$, the heater means comprising the separable path; and resettable means for reconnecting the electrical connection between the separable path and at least one contact after the breaker means causes the electrical connection between the separable path and the contacts to be broken.

2. The over-current/over-temperature protection device of claim 1, wherein the separable path further comprises a layer of dielectric material on the conductive layer, the dielectric material preventing flow of electrical current from the separable path to the member, the dielectric material also conducting heat to the member, the heat being produced by the conductive layer when current flows through the separable path.

3. An over-current/over-temperature protection device, comprising:

first and second electrical contacts;

a separable resistance electrical current path forming an electrical connection between the contacts, the separable path having a resistance to flow of electrical current therethrough;

breaker means for preventing flow of electrical current between the contacts through the separable path when current above a threshold value flows through the separable path and/or the over-current/over-temperature protection device reaches a threshold temperature, the means comprising a member of a shape memory alloy which undergoes a metallurgical phase change when heated from a first temperature $T_1$ to a second temperature $T_2$, the member when unrestrained being capable of changing from a first configuration into a second configuration when heated from the first temperature $T_1$ to the second temperature $T_2$, the separable path being separated from at least one of the contacts when the member is heated to the second temperature $T_2$;

heater means for heating the member from the first temperature $T_1$ to the second temperature $T_2$, the heater means comprising the separable path;

resettable means for reconnecting the electrical connection between the separable path and at least one contact after the breaker means causes the electrical connection between the separable path and the contacts to be broken; and the contacts being immovable with respect to each other, the separable path having contact zones which are movable from a first position in electrical contact with the contacts to a second position out of electrical contact with the contacts, the contact zones being in the first position when the member is at the first temperature $T_1$ and the contact zones being in the second position when the member is at the second temperature $T_2$.

4. The over-current/over-temperature protection device of claim 3, wherein the member is U-shaped, the contacts being located between free ends of the U-shaped member, the ends of the U-shaped member being urged apart when the U-shaped member is at the second temperature $T_2$.

5. The over-current/over-temperature protection device of claim 3, further comprising spring means for biasing the member so as to be U-shaped when the member is at the first temperature $T_1$ when the member is at the second temperature $T_2$.

6. The over-current/over-temperature protection device of claim 1, wherein the resettable means comprises a manually movable push button.

7. The over-current/over-temperature protection device of claim 6, wherein the push button moves rectilinearly to slide the separable path from a second position wherein the electrical connection is broken to a first position wherein the electrical connection is reconnected.

8. An over-current/over-temperature protection device, comprising:

first and second electrical contacts;

a separable resistance electrical current path forming an electrical connection between the contacts, the separable path having a resistance to flow of electrical current therethrough;

breaker means for preventing flow of electrical current between the contacts through the separable path when current above a threshold value flows through the separable path and/or the over-current/over-temperature protection device reaches a threshold temperature, the means comprising a member of a shape memory alloy which undergoes a metallurgical phase change when heated from a first temperature $T_1$ to a second temperature $T_2$, the member when unrestrained being capable of changing from a first configuration into a second configuration when heated from the first temperature $T_1$ to the second temperature $T_2$, the separable path being separated from at least one of the contacts when the member is heated to the second temperature $T_2$;

heater means for heating the member from the first temperature $T_1$ to the second temperature $T_2$, the heater means comprising the separable path;

resettable means for reconnecting the electrical connection between the separable path and at least one contact after the breaker means causes the electrical connection between the separable path and the contacts to be broken; and arc minimizing means for minimizing arcing when the electrical connection between at least one of the contacts and the separable path is broken by the breaker means, the arc minimizing means comprising wiping means for sliding the separable path against at least one of the contacts when the separable path is broken by the breaker means.

9. The over-current/over-temperature protection device of claim 8, wherein the wiping means slides at least one of the contacts against the separable path when the separable path is electrically reconnected to the contacts by the resettable means.

10. The over-current/over-temperature protection device of claim 5, further comprising a housing, the contacts being fixedly mounted in an interior space within the housing, the spring means comprising a strip of spring material having an arcuate central portion and end sections extending from the central portion, each of the contact zones of the separable path being attached to a respective one of the end sections, the spring biasing the contact zones of the separable path toward the contacts, the ends of the U-shaped member urging the end sections of the spring means apart with greater force when the U-shaped member is at the second temperature $T_2$ than when the U-shaped member is at the first temperature $T_1$.

11. The over-current/over-temperature protection device of claim 10, further comprising tube spring means for moving the separable path from the first position when the U-shaped member is at the first temperature $T_1$ to the second position when the U-shaped member is at the second temperature $T_2$, the tube spring means comprising a tube spring which can be elastically deformed from a circular configuration into a non-circular configuration, the tube spring being deformable into a non-circular configuration when the U-shaped member is at the first temperature $T_1$ and the tube spring elastically returning to the circular configuration when the member is heated from the first temperature $T_1$ to the second temperature $T_2$, the tube spring being located in the interior of the housing between a support surface and a concave surface of the U-shaped member.

12. The over-current/over-temperature protection device of claim 11, wherein the U-shaped member is in a martensitic state when the U-shaped member is at the first temperature $T_1$ and the U-shaped member is in an austenitic state when the U-shaped member is at the second temperature $T_2$.

13. The over-current/over-temperature protection device of claim 9, wherein the wiping means comprises a tube spring which can be elastically deformed from a circular configuration into a non-circular configuration, the tube spring being deformable into the non-circular configuration when the member is at the first temperature $T_1$ and the tube spring elastically returning to the circular configuration when the member is heated from the first temperature $T_1$ to the second temperature $T_2$.

14. The over-current/over-temperature protection device of claim 12, wherein the resettable means comprises a push button having a first portion located outside the housing and a second portion located inside the housing, the second portion moving the U-shaped member toward the tube spring so as to elastically deform the tube spring into the non-circular configuration when the first portion is moved toward the interior of the housing.

15. The over-current/over-temperature protection device of claim 1, wherein the resettable means comprises a second heater means for heating the member from the first temperature $T_1$ to the second temperature $T_2$, the second heater means comprising a control current path, the member being heated to the second temperature when current above a threshold value passes through the control current path.

16. The over-current/over-temperature protection device of claim 15, wherein the member changes shape from the first configuration to the second configuration when the member is heated from the first temperature $T_1$ to the second temperature $T_2$.

17. The over-current/over-temperature protection device of claim 16, wherein the member is U-shaped and the ends of the U-shaped member are located closer together in the first configuration than in the second configuration, the device further comprising a support surface facing a concave surface of the U-shaped member, the control current path being supported on the support surface.

18. The over-current/over-temperature protection device of claim 17, wherein the contacts are fixedly mounted on a base, the separable path having contact zones which are movable from a first position in electrical contact with the contacts to a second position out of electrical contact with the contacts, the contact zones being in the first position when the U-shaped member is in the first configuration and the contact zones being in the second position when the U-shaped member is in the second configuration, the device further comprising spring means for bending the U-shaped member in the first configuration when the U-shaped member is at the first temperature $T_1$, the spring means also biasing the contact zones of the separable path in the first position.

19. The over-current/over-temperature protection device of claim 16, wherein the control current path is effective for heating the member independently of the heater means, the control current path being effective to change the member from the first configuration to the second configuration by passing current above the threshold value through the control current path and changing the member back into the first configuration by interrupting the flow of current through the control current path.

* * * * *